US009532432B2

(12) United States Patent
Lee et al.

(10) Patent No.: US 9,532,432 B2
(45) Date of Patent: Dec. 27, 2016

(54) LED DRIVER APPARATUS

(71) Applicant: Magnachip Semiconductor, Ltd., Cheongju-si (KR)

(72) Inventors: Wan-jik Lee, Cheongju-si (KR); Ji-won Choi, Cheongju-si (KR); Chang-sik Lim, Cheongju-si (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 259 days.

(21) Appl. No.: 13/693,570

(22) Filed: Dec. 4, 2012

(65) Prior Publication Data

US 2013/0147382 A1 Jun. 13, 2013

(30) Foreign Application Priority Data

Dec. 7, 2011 (KR) ..... 10-2011-0130482

(51) Int. Cl.
*H05B 37/02* (2006.01)
*H05B 33/08* (2006.01)
*G09G 3/34* (2006.01)

(52) U.S. Cl.
CPC ..... *H05B 37/02* (2013.01); *G09G 3/3406* (2013.01); *H05B 33/0815* (2013.01); *H05B 33/0848* (2013.01); *H05B 33/0887* (2013.01)

(58) Field of Classification Search
CPC . H05B 33/0815; H05B 33/0818; H05B 37/02; H05B 33/0827; H05B 41/3927; H05B 33/0812; H05B 33/086; H05B 33/0887; H05B 37/029; H05B 37/032; H05B 37/036; H05B 33/0848; Y02B 20/347; Y02B 20/346; Y02B 20/343; Y02B 70/1466; G09G 3/3406
USPC ..... 315/246, 247, 250, 224, 225, 185 S, 315/274–279, 291, 307–326, 210, 209 R
See application file for complete search history.

(56) References Cited

U.S. PATENT DOCUMENTS 7,321,203 B2 * 1/2008 Marosek ..... H05B 33/0815 315/209 R
8,169,163 B2 * 5/2012 Kang ..... G09G 3/342 315/185 R
8,582,324 B2 * 11/2013 Lin ..... H02M 1/14 363/21.12
2007/0120725 A1 5/2007 Huang
(Continued)

FOREIGN PATENT DOCUMENTS

CN 102047760 A 5/2011

OTHER PUBLICATIONS

Chinese Office Action issued on Nov. 4, 2015 in counterpart Chinese Application No. 201210523725.X (7 pages in Chinese).

*Primary Examiner* — Vibol Tan
(74) *Attorney, Agent, or Firm* — NSIP Law

(57) ABSTRACT

A light emitting diode (LED) driver apparatus is provided. The LED driver apparatus includes an input unit, a PWM signal generation unit, a DC-DC converter, an LED driving unit, and a synchronization unit. The input unit is configured to receive a dimming signal. The PWM signal generation unit is configured to generate a PWM signal using an oscillator having a preset frequency. The DC-DC converter is configured to provide a driving voltage to an LED array using the generated PWM signal. The LED driving unit is configured to drive the LED array using the received dimming signal. The synchronization unit is configured to reset the oscillator based on a driving state of the LED array.

17 Claims, 5 Drawing Sheets

(56) References Cited

U.S. PATENT DOCUMENTS

| | | | | |
|---|---|---|---|---|
| 2010/0079127 | A1* | 4/2010 | Grant | 323/285 |
| 2011/0062870 | A1* | 3/2011 | Kanbara | 315/77 |
| 2011/0285307 | A1* | 11/2011 | Kimura et al. | 315/250 |
| 2012/0112655 | A1* | 5/2012 | Ryu | H05B 33/0815 315/291 |
| 2012/0112656 | A1* | 5/2012 | Ryu | H05B 33/0812 315/291 |
| 2012/0120342 | A1* | 5/2012 | Uchimoto et al. | 349/61 |
| 2013/0049614 | A1* | 2/2013 | Kang | H05B 37/02 315/186 |

* cited by examiner

LED DRIVER APPARATUS

CROSS-REFERENCE TO RELATED APPLICATION

This application claims priority from Korean Patent Application No. 10-2011-0130482, filed on Dec. 7, 2011, in the Korean Intellectual Property Office, the disclosure of which is incorporated herein by reference in its entirety.

BACKGROUND

1. Field

The following description relates to a light emitting diode (LED) driver apparatus, and more particularly, to an LED driver apparatus configured to synchronize an oscillator therein according to a driving state of an LED array.

2. Description of the Related Art

Liquid crystal displays (LCDs) are thin and heavy and have a lower driving voltage and low power consumption compared to other display devices and are widely used. However, because the LCDs are non-emitting device and cannot inherently emit light, separate backlights are necessary to supply light to LC panels.

Examples of backlights as light sources for the LCD include cold cathode fluorescent lamps (CCFLs), light emitting diodes (LEDs), and the like. However, the CCLFs are undesirable because they may cause environment pollutions due to mercury, have a low response time and lower reproducibility, and are not appropriate for lightness, thinness, shortness, and smallness of the LC panel.

In contrast, the LEDs are environmentally friendly and do not use environment pollution materials and are capable of an impulse driving. The LEDs have good reproducibility and have advantages of being light, thin, short, and small to accommodate to the LC panels. The LEDs may further arbitrarily change a luminance, a color temperature, or the like by adjusting light intensities of red, green, and blue LEDs. As a result, the LEDs are widely employed as a light source for a backlight of the LC panel, or the like in recent years.

For the LCD backlight using the LED, when a plurality of LEDs connected in series are used, a driving circuit and a dimming circuit are necessary. The driving circuit provides a fixed constant current to the LEDs, and the dimming circuit arbitrarily adjusts luminance, a color temperature, and the like or compensates a temperature.

Specifically, an analog dimming method and a digital dimming method may be used as methods to dim an LED. The analog dimming method adjusts brightness of an LED by controlling an amount of current applied to the LED. A pulse width modulation (PWM) dimming method, which is one of the digital dimming methods, adjusts brightness of an LED by controlling an ON/OFF ratio of the LED. For example, when a PWM signal having the ON/OFF ratio of 4:1 is applied to the LED, the brightness of the LED becomes about 80 percents of maximum brightness.

When the brightness of the LED is adjusted using the digital dimming method, a clock signal of a direct current (DC)-DC converter, which adjusts power of the LED, and a dimming signal, which controls an amount of current of the LED, are separately provided to the LED.

A switching frequency of the DC-DC converter is synchronized with a rising edge of the dimming signal so that the DC-DC converter allows to be accurately switched to an ON period of the dimming signal.

However, because the oscillator generating the switching frequency of the DC-DC converter is synchronized using the above-described synchronization method, a frequency of the oscillator is changed by the dimming signal. Therefore, because the frequency of the oscillator is affected by a dimming frequency at a point of synchronization time, noise occurs when the dimming frequency is in an audible frequency band. Specifically, when the oscillator is synchronized with a rising edge of the dimming signal, power is provided to an LED array without a rectifying state of a driving voltage and, thus, output ripple increases.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One or more exemplary configurations provide a light emitting diode (LED) driver apparatus configured to synchronize an oscillator according to a driving state of an LED array.

In accordance with an illustrative example, there is provided a light emitting diode (LED) driver apparatus, including a pulse width modulation (PWM) signal generation unit configured to generate a PWM signal using an oscillator having a preset frequency; a direct current (DC)-DC converter configured to provide a driving voltage to an LED array using the generated PWM signal; an LED driving unit configured to drive the LED array using a dimming signal; and a synchronization unit configured to reset the oscillator based on a driving state of the LED array.

The synchronization unit resets the oscillator when a feedback voltage of the LED array is equal to or lower than a preset first reference voltage.

The synchronization unit includes a comparator configured to output a high level signal as a reset signal of the oscillator when the feedback voltage of the LED array is equal to or lower than the preset first reference voltage.

The preset first reference voltage is greater than the feedback voltage at a normal operation of the LED array.

The LED driving unit is further configured to drive a plurality of LED arrays. The synchronization unit includes a plurality of comparators, each comparator configured to output a high level signal when the feedback voltage of corresponding one of the plurality of LED arrays is equal to or lower than the preset first reference voltage; an OR gate configured to receive output signals of the plurality of comparators and output a logic-OR result; and a pulse output unit configured to receive an output signal of the OR gate and output a pulse signal corresponding to the output signal of the OR gate as a reset signal from the oscillator.

The synchronization unit resets the oscillator when a current provided to the LED array is equal to or greater than a preset first reference current.

The synchronization unit includes a current comparator configured to output a high level signal as a reset signal of the oscillator when the current provided to the LED array is equal to or greater than the preset first reference current.

The current comparator includes a current source configured to output the preset first reference current; a transistor configured to receive a feedback voltage from the LED array at a drain thereof; first and second resistors operatively connected in series between the current source and a ground terminal; a third resistor arranged between a source of the transistor and the ground terminal; a first operational amplifier of which a non-inverting terminal operatively connected to a first node commonly connected to the current source and one terminal of the first resistor, an inverting terminal operatively connected to a second node, which is commonly connected to a source of the transistor and the third resistor, and an output terminal operatively connected to a gate of the transistor; and a second operational amplifier including an inverting terminal operatively connected to a third node, which is commonly connected to another terminal of the first resistor and one terminal of the second resistor, and a non-inverting terminal operatively connected to the second node, which is commonly connected to the source of the transistor and the third resistor, and configured to output an input difference between the non-inverting terminal and the inverting terminal as the reset signal from the oscillator.

The preset first reference current is lower than a constant current at a normal operation of the LED array.

The LED driving unit is further configured to drive a plurality of LED arrays. The synchronization unit includes a plurality of current comparators, each current comparator configured to output a high level signal when a current flowing in one of the corresponding plurality of LED arrays is equal to or greater than the preset first reference current; an OR gate configured to receive output signals from the plurality of current comparators and output a logic-OR result; and a pulse output unit configured to receive an output signal from the OR gate and output a pulse signal corresponding to the output signal from the OR gate as the reset signal from the oscillator.

In accordance with an illustrative example, there is provided a light emitting diode (LED) driver apparatus, including a synchronization unit configured to measure a feedback voltage of an LED array or a constant current flowing through the LED array to determine a point in time to drive the LED array, generate a reset signal to an oscillator at a pulse width modulation (PWM) signal generation unit at the point in time when the LED array is driven, generate the reset signal to the oscillator when the feedback voltage of the LED array is equal to or lower than a preset first reference voltage, and generate the reset signal the oscillator when the current provided to the LED array is equal to or greater than the preset first reference voltage to maintain a constant output voltage and a constant output current.

The pulse width modulation (PWM) signal generation unit is configured to generate a PWM signal using the oscillator having a preset frequency.

The LED driver apparatus further includes a direct current (DC)-DC converter configured to provide a driving voltage to the LED array using the generated PWM signal; and an LED driving unit configured to drive the LED array using a dimming signal.

The preset first reference voltage is greater than the feedback voltage at a normal operation of the LED array.

The LED driving unit is further configured to drive a plurality of LED arrays. The synchronization unit includes a plurality of comparators, each comparator configured to output a high level signal when the feedback voltage of corresponding one of the plurality of LED arrays is equal to or lower than the preset first reference voltage; an OR gate configured to receive output signals of the plurality of comparators and output a logic-OR result; and a pulse output unit configured to receive an output signal of the OR gate and output a pulse signal corresponding to the output signal of the OR gate as the reset signal from the oscillator.

The synchronization unit includes a current comparator including a current source configured to output the preset first reference current; a transistor configured to receive a feedback voltage from the LED array at a drain thereof; first and second resistors operatively connected in series between the current source and a ground terminal; a third resistor arranged between a source of the transistor and the ground terminal; a first operational amplifier of which a non-inverting terminal operatively connected to a first node commonly connected to the current source and one terminal of the first resistor, an inverting terminal operatively connected to a second node, which is commonly connected to a source of the transistor and the third resistor, and an output terminal operatively connected to a gate of the transistor; and a second operational amplifier including an inverting terminal operatively connected to a third node, which is commonly connected to another terminal of the first resistor and one terminal of the second resistor, and a non-inverting terminal operatively connected to the second node, which is commonly connected to the source of the transistor and the third resistor, and configured to output an input difference between the non-inverting terminal and the inverting terminal as the reset signal from the oscillator.

The preset first reference current is lower than a constant current at a normal operation of the LED array.

The LED driving unit is further configured to drive a plurality of LED arrays. The synchronization unit includes a plurality of current comparators, each current comparator configured to output a high level signal when a current flowing in one of the corresponding plurality of LED arrays is equal to or greater than the preset first reference current; an OR gate configured to receive output signals from the plurality of current comparators and output a logic-OR result; and a pulse output unit configured to receive an output signal from the OR gate and output a pulse signal corresponding to the output signal from the OR gate as the reset signal from the oscillator.

According to the LED driver apparatus according to the exemplary configuration synchronizes an oscillator therein according to a driving state of an LED array to maintain a constant output current and a constant voltage, thereby reducing ripple.

Additional aspects and advantages of the exemplary configurations will be set forth in the detailed description, will be obvious from the detailed description, or may be learned by practicing the exemplary embodiments.

BRIEF DESCRIPTION OF THE DRAWINGS

The above and/or other aspects will be more apparent by describing in detail exemplary configurations, with reference to the accompanying drawings, in which.

DETAILED DESCRIPTION

Figure 1:
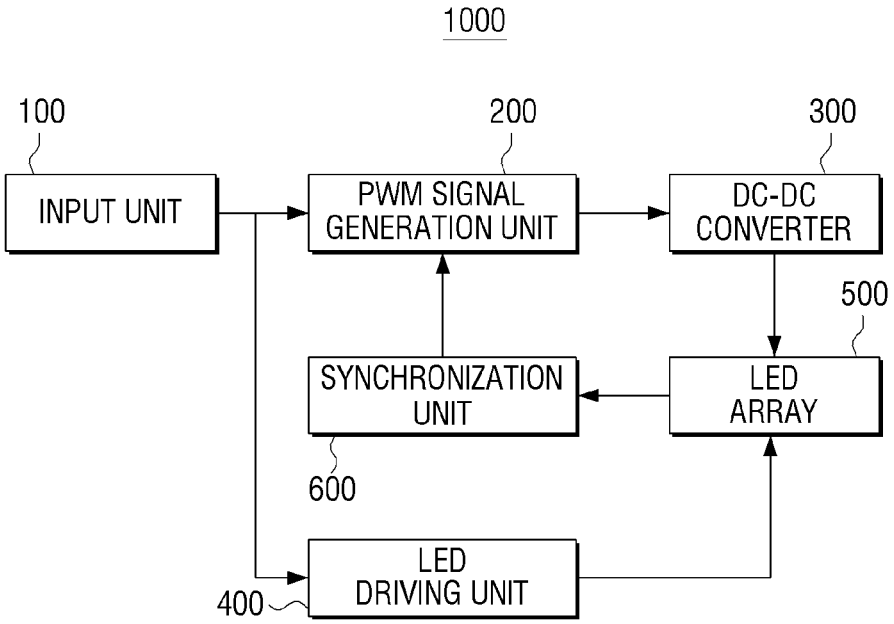
FIG. 1 is a block diagram illustrating a light emitting diode (LED) driver apparatus, according to illustrative configuration.

Hereinafter, exemplary configuration will be described in greater detail with reference to the accompanying drawings.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness. Throughout the drawings and the detailed description, unless otherwise described, the same drawing reference numerals will be understood to refer to the same elements, features, and structures. The relative size and depiction of these elements may be exaggerated for clarity, illustration, and convenience.

It will be understood that when an element is referred to as being "on," "connected to," or "operatively connected to" another element or unit, it can be directly on or connected to another element or unit through intervening elements or units. In contrast, when an element is referred to as being "directly on" or "directly connected to" another element or layer, there are no intervening elements or layers present. Like reference numerals refer to like elements throughout. As used herein, the term "and/or" includes any and all combinations of one or more of the associated listed items.

The units described herein may be implemented using hardware components. The hardware components may include, for example, controllers, processors, generators, drivers, resistors, filters, transistors, metal-oxide-semiconductor field-effect transistor (MOSFETs), metal-insulator-semiconductor FET (MISFETs), metal-oxide-semiconductors (MOSs), and other equivalent electronic components.

FIG. 1 is a block diagram illustrating a light emitting diode (LED) driver apparatus, according to an illustrative configuration.

Referring to FIG. 1, a LED driver apparatus 1000 includes an input unit 100, a pulse width modulation (PWM) signal generation unit 200, a direct current (DC)-DC converter 300, an LED driving unit 400, an LED array 500, and a synchronization unit 600.

The input unit 100 receives a dimming signal to drive the LED array 500. A direct mode, a fixed phase mode, and a phase shift mode are digital dimming method for an LED. In one example, the direct method is a method to externally control all a PWM frequency and an ON duty signal from a pad. The fixed phase method and the phase shift method are methods to internally generate the PWM frequency in an integrated circuit (IC) and control only the ON duty signal received from the pad. The diming signal is a signal to adjust luminance, a color temperature, and the like of the LED or a signal for temperature compensation.

The PWM signal generation unit 200 includes an oscillator (210 of FIG. 2) having a preset frequency. The PWM signal generation unit 200 may generate a PWM signal to control a magnitude of a driving voltage of the DC-DC converter 300 using the oscillator 210.

The DC-DC converter 300 includes a transistor configured to perform a switching operation and provides a driving voltage to the LED array 500 through the switching operation of the transistor. For example, the DC-DC converter 300 converts a DC voltage based on the PWM signal generated in the PWM signal generation unit 200 and provides the converted DC voltage (that is, a driving voltage) to the LED array 500. In one instance, the DC-DC converter 300 may provide a voltage corresponding to a forward bias voltage of the LED array 500 to the LED array 500, thereby allowing the LED array 500 to operate in a saturation region.

The LED driving unit 400 provides a constant current to drive the LED array 500 using the dimming signal. Specifically, the LED driving unit 400 adjusts a magnitude of a driving current in the LED array 500 using the dimming signal and provides the adjusted contact current (that is, the driving current) to the LED array 500.

The LED array 500 includes a plurality of LEDs which are connected in series and perform a light-emitting operation. The LED array 500 may be implemented with one array or a plurality of arrays connected in parallel.

The synchronization unit 600 resets the oscillator 210 based on a driving state of the LED array 500. Specifically, the synchronization unit 600 resets the oscillator 210 at a point in time when the LED array 500 is driven, which is after the dimming signal is input and a preset point in time passes. The synchronization unit 600 measures a feedback voltage of the LED array 500 or a constant current flowing through the LED array 500 to determine a point in time to drive the LED array 500. The synchronization unit 600 measures and uses the feedback voltage in accord with a first illustrative configuration as described below with reference to FIG. 2. In addition, a synchronization unit 600', which measures and uses the driving current of the LED array, according to a second illustrative configuration as described below with reference to FIG. 4. In one example, the feedback voltage is a voltage measured at a node at which the LED array 500 and the LED driving unit 400 are commonly connected.

The LED driver apparatus 1000, according to the above-described configuration, synchronizes the oscillator therein according to a driving state of the LED array 500 and maintains a constant output voltage and a constant output current, thereby reducing ripple.

Although FIG. 1 illustrates the input unit 100, the PWM signal generation unit 200, the DC-DC converter 300, the LED driving unit 400, and the synchronization unit 600 as separately configured, the above-described converter and units may be implemented with a single integrated circuit (IC).

Figure 2:
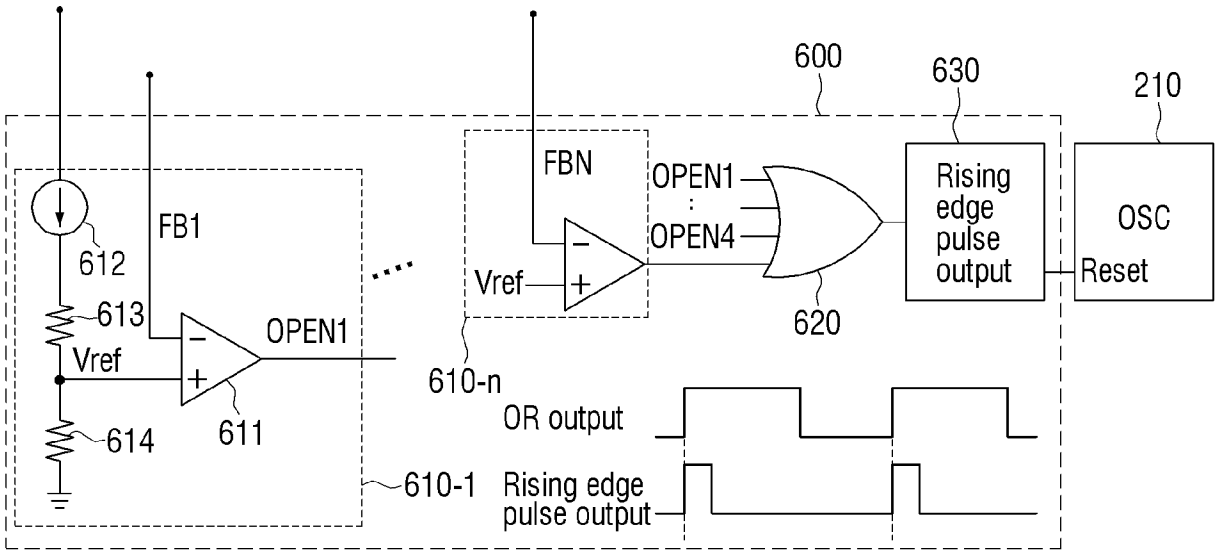
FIG. 2 is a circuit diagram illustrating a synchronization unit, according to a first illustrative configuration.

FIG. 2 is a circuit diagram of the synchronization unit 600, according to the first illustrative configuration.

Referring to FIG. 2, the synchronization unit 600 includes a plurality of comparators 610-1 to **610-*n*, an OR gate 620, and a pulse output unit 630**.

Each of the plurality of comparators 610-1 to **610-*n* may be implemented with a comparator 611 that is configured to output a high level signal when a feedback voltage FB1 to FBn of the LED array 500 is equal to or lower than a preset first reference voltage, Vref. Specifically, the comparator 610-1 receives the feedback voltage FB1 from the LED array 500 corresponding to the comparator 610-1 at an inverting terminal thereof and the preset first reference voltage, Vref, at a non-inverting terminal thereof. In one example, the first reference voltage, Vref, is a voltage greater than the feedback voltage from the corresponding LED array 500 in a normal operation of the LED array 500 and may be implemented by one constant current source 612 and two resistors 613 and 614 as shown in FIG. 2**. A magnitude of the first reference voltage may be changed according to a particular LED driver used and associated system and an optimized voltage value may be selected as the first reference voltage by a manufacturer.

The OR gate 620 receives output signals OPEN1 to OPENn from the plurality of comparators 610-1 to **610-*n* and outputs a logic-OR result. Specifically, the OR gate 620** receives the output signals of the plurality of comparators 610-1 to 610-*n* as input signals and outputs the logic-OR result to the pulse output unit 630.

The pulse output unit 630 generates a reset signal of the oscillator. Specifically, the pulse output unit 630 receives the logic-OR result from the OR gate 620, converts the output of the OR gate 620 to a pulse signal, and outputs the converted pulse signal as the reset signal, Reset, of the oscillator 210 as shown in FIG. 2.

The operation of the synchronization unit 600 has been described when the plurality of LED arrays 500 are provided in the LED driver apparatus 1000 with reference to FIG. 2. However, when the LED driver apparatus 1000 drives one LED array 500, a synchronization unit 600 may be implemented using one of the plurality of comparators 610-1 to 610-*n* in the synchronization unit 600.

Figure 3:
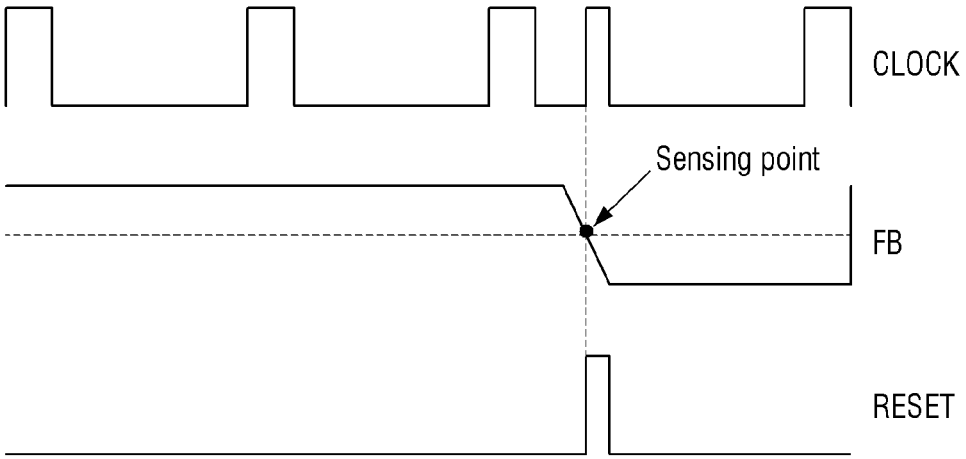
FIG. 3 is a waveform diagram illustrating an operation of the synchronization unit, according to the first illustrative configuration.

FIG. 3 is a waveform diagram explaining an operation of the synchronization unit, according to the first illustrative configuration.

As illustrated in FIG. 3, when the dimming signal is received, the LED array 500 is driven, and a feedback voltage FB becomes lower than the preset first reference voltage, the synchronization unit 600 outputs a reset signal, RESET, and, as a result, a clock signal, CLOCK, of the oscillator 210 is reset.

The synchronization unit 600, according to the above-described first illustrative configuration, synchronizes the oscillator in the LED driver apparatus 1000 according to the feedback voltage corresponding to the driving voltage of the LED array 500 to maintain a constant output voltage and a constant output current, thereby reducing ripple.

Figure 4:
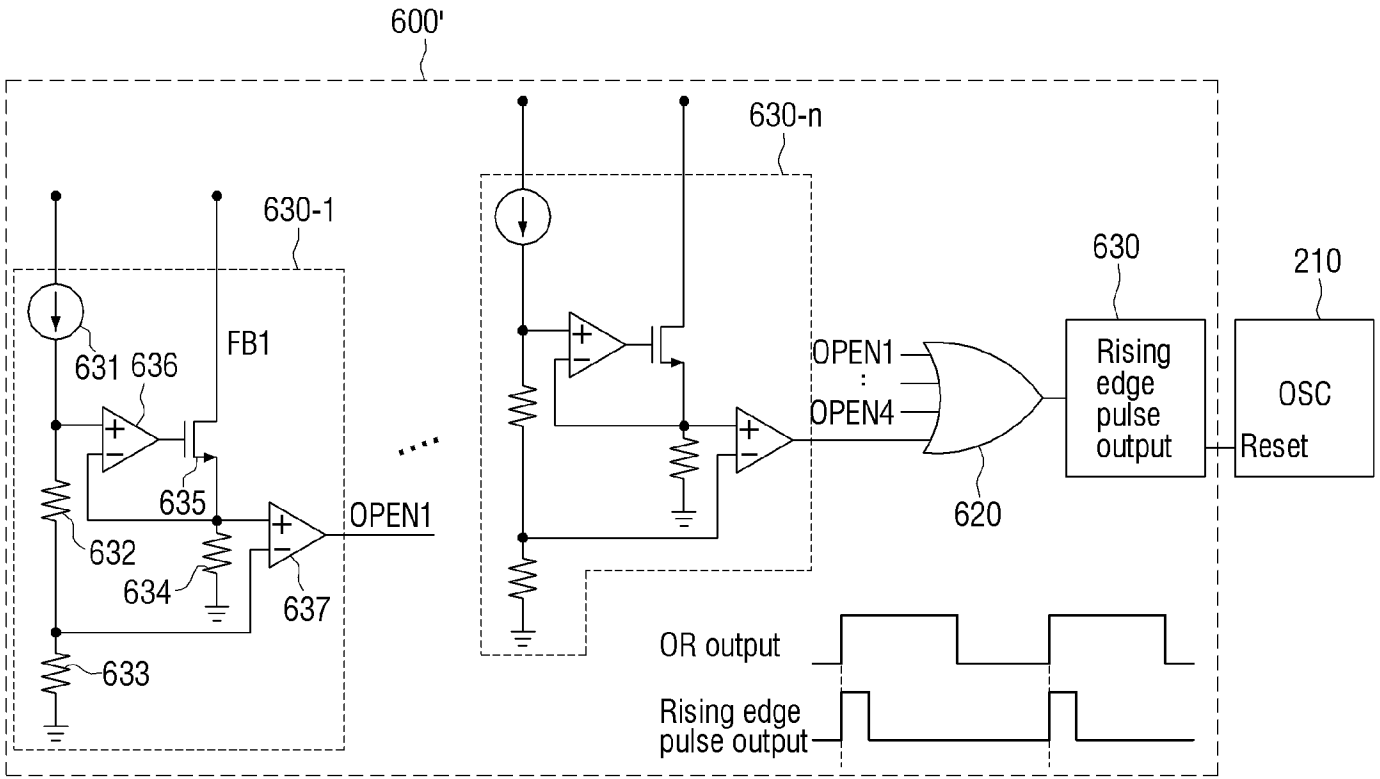
FIG. 4 is a circuit diagram illustrating a synchronization unit, according to a second illustrative configuration.

FIG. 4 is a circuit diagram of a synchronization unit 600', according to a second illustrative configuration.

Referring to FIG. 4, the synchronization unit 600' includes a plurality of current comparators 630-1 to 630-*n* and an OR gate 620.

Each of the plurality of comparators 630-1 to 630-*n* are implemented with a current comparator configured to output a high level signal when a current flowing in the LED array 500 is equal to or greater than a preset first reference current. For example, one comparator 630-1 includes a current source 631, a first resistor 632, a second resistor 633, a third resistor 634, a transistor 635, a first operational amplifier 636, and a second operational amplifier 637.

The current source 631 outputs the preset first reference current. In one example, the preset first reference current is a current lower than a constant current in a normal operation of the LED array 500. A magnitude of the first reference current may be changed according to a particular LED driver used and associated system and an optimized current value may be selected as the first reference current by a manufacturer.

The first resistor 632 has one terminal that is commonly connected to the current source 631 and a non-inverting terminal of the first operational amplifier 636. The other terminal of the first resistor 632 is commonly connected to one terminal of the second resistor 633 and an inverting terminal of the second operational amplifier 637.

The second resistor 633 has one terminal that is commonly connected to the other terminal of the first resistor 632 and the inverting terminal of the second operational amplifier 637. The other terminal of the second resistor 633 is grounded.

The third resistor 634 has one terminal that is commonly connected to a source of the transistor 635, an inverting terminal of the first operational amplifier 636, and a non-inverting terminal of the second operational amplifier 637. The other terminal of the third resistor 634 is grounded.

The transistor 635 has a drain that receives the feedback voltage from the LED array 500. A source of the transistor 635 is commonly connected to the one terminal of the third resistor 634, the inverting terminal of the first operational amplifier 636, and the non-inverting terminal of the second operational amplifier 637. A gate of the transistor 635 is connected to an output terminal of the first operational amplifier 636.

The non-inverting terminal of the first operational amplifier 636 is commonly connected to the current source 631 and the one terminal of the first resistor 632. The inverting terminal of the first operational amplifier 636 is commonly connected to the source of the transistor 635, the one terminal of the third resistor 634, the non-inverting terminal of the second operational amplifier 637. The output terminal of the first operational amplifier 636 is connected to the gate of the transistor 635.

The non-inverting terminal of the second operational amplifier 637 is commonly connected to the source of the transistor 635, the inverting terminal of the first operational amplifier 636, and the one terminal of the third resistor 634. The inverting terminal of the second operational amplifier 637 is commonly connected to the other terminal of the first resistor 632 and the one terminal of the second resistor 633. An output terminal, OPEN1, of the second operational amplifier 637 outputs a difference between the non-inverting terminal and the inverting terminal.

The OR gate 620 receives output signals OPEN1 to OPENn from the plurality of current comparators 630-1 to 630-*n* and outputs a logic-OR result.

The pulse output unit 630 generates a reset signal, Reset, for the oscillator 210. Specifically, the pulse output unit 630 receives the logic-OR result from the OR gate 620, converts an output of the OR gate 620 into a pulse signal, and outputs the pulse signal as the reset signal, RESET, to the oscillator 210, as shown in FIG. 4.

The operation of the synchronization unit 600' when the plurality of LED arrays are provided in the LED driver apparatus is described with reference to FIG. 4. However, when the LED driver apparatus 1000 drives one LED array, a synchronization unit 600' may be implemented with one of the plurality of current comparators 630-1 to 630-*n* in the synchronization unit 600'.

Figure 5:
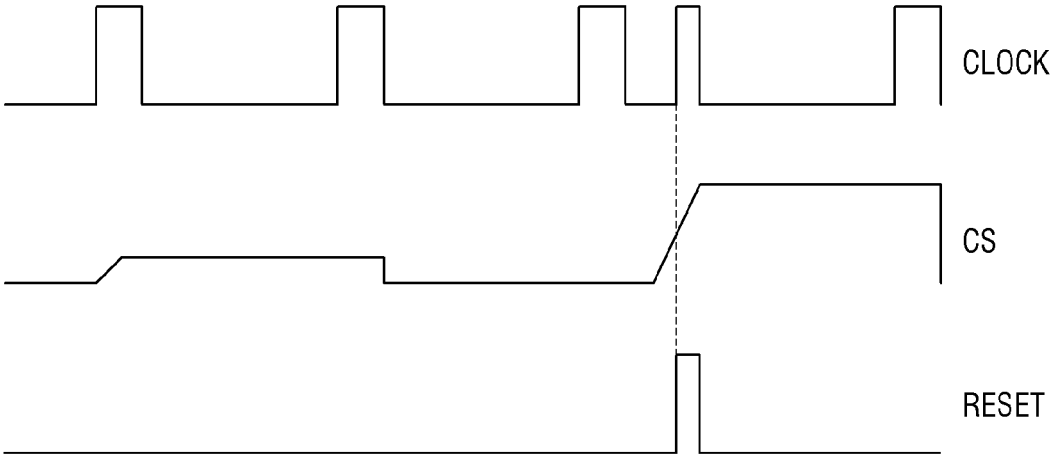
FIG. 5 is a waveform diagram illustrating an operation of the synchronization unit, according to the second illustrative configuration.

FIG. 5 is a waveform diagram explaining an operation of the synchronization unit, according to the second illustrative configuration.

As illustrated in FIG. 5, when the dimming signal is received, the LED array 500 is driven, and a current CS flowing through the LED array 500 is greater than the preset first reference current, the synchronization unit 600' outputs a reset signal RESET, and a clock signal, CLOCK, of the oscillator 210 is reset.

The synchronization unit 600', according to the above-described second illustrative configuration, synchronizes the oscillator provided in the LED driver apparatus 1000 based on a driving current of the LED array 500 and maintains a constant output voltage and a constant output current, to reduce ripple.

It will be understood that, although the terms first, second, third, etc. may be used herein to describe various elements, components, units and/or sections, these elements, components, units and/or sections should not be limited by these terms. These terms are only used to distinguish one element, component, unit or section from another region, layer or section. These terms do not necessarily imply a specific order or arrangement of the elements, components, regions, layers and/or sections. Thus, a first element, component, unit or section discussed below could be termed a second element, component, unit or section without departing from the teachings description of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A light emitting diode (LED) driver apparatus, comprising:

a pulse width modulation (PWM) signal generation unit configured to generate a PWM signal using an oscillator having a preset frequency;

a direct current (DC)-DC converter configured to provide a driving voltage to an LED array using the generated PWM signal;

an LED driving unit configured to drive the LED array using a dimming signal; and a synchronization unit configured to reset a clock signal of the oscillator by synchronizing the oscillator to restart at a point in which a feedback voltage of the LED array is equal to or less than a preset first reference voltage.

2. The LED driver apparatus as claimed in claim 1, wherein the synchronization unit includes a comparator configured to output a high level signal as a reset signal of the oscillator when the feedback voltage of the LED array is equal to or lower than the preset first reference voltage.

3. The LED driver apparatus as claimed in claim 1, wherein the preset first reference voltage is greater than the feedback voltage at a normal operation of the LED array.

4. The LED circuit apparatus as claimed in claim 1, wherein the LED driving unit is further configured to drive a plurality of LED arrays, wherein the synchronization unit comprises:

a plurality of comparators, each comparator configured to output a high level signal when the feedback voltage of corresponding one of the plurality of LED arrays is equal to or lower than the preset first reference voltage;

an OR gate configured to receive output signals of the plurality of comparators and output a logic-OR result; and a pulse output unit configured to receive an output signal of the OR gate and output a pulse signal corresponding to the output signal of the OR gate as a reset signal from the oscillator.

5. A light emitting diode (LED) driver apparatus, comprising:

a pulse width modulation (PWM) signal generation unit configured to generate a PWM signal using an oscillator having a preset frequency;

a direct current (DC)-DC converter configured to provide a driving voltage to an LED array using the generated PWM signal;

an LED driving unit configured to drive the LED array using a dimming signal; and a synchronization unit configured to reset a clock signal of the oscillator in response to a current provided to the LED array being equal to or greater than a preset first reference current.

6. The LED driver apparatus as claimed in claim 5, wherein the synchronization unit includes a current comparator configured to output a high level signal as a reset signal of the oscillator when the current provided to the LED array is equal to or greater than the preset first reference current.

7. The LED driver apparatus as claimed in claim 6, wherein the current comparator comprises:

a current source configured to output the preset first reference current;

a transistor configured to receive a feedback voltage from the LED array at a drain thereof;

first and second resistors operatively connected in series between the current source and a ground terminal;

a third resistor arranged between a source of the transistor and the ground terminal;

a first operational amplifier of which a non-inverting terminal operatively connected to a first node commonly connected to the current source and one terminal of the first resistor, an inverting terminal operatively connected to a second node, which is commonly connected to a source of the transistor and the third resistor, and an output terminal operatively connected to a gate of the transistor; and a second operational amplifier comprising an inverting terminal operatively connected to a third node, which is commonly connected to another terminal of the first resistor and one terminal of the second resistor, and a non-inverting terminal operatively connected to the second node, which is commonly connected to the source of the transistor and the third resistor, and configured to output an input difference between the non-inverting terminal and the inverting terminal as the reset signal from the oscillator.

8. The LED driver apparatus as claimed in claim 5, wherein the preset first reference current is lower than a constant current at a normal operation of the LED array.

9. The LED driver apparatus as claimed in claim 5, wherein the LED driving unit is further configured to drive a plurality of LED arrays, wherein the synchronization unit comprises:

a plurality of current comparators, each current comparator configured to output a high level signal when a current flowing in one of the corresponding plurality of LED arrays is equal to or greater than the preset first reference current;

an OR gate configured to receive output signals from the plurality of current comparators and output a logic-OR result; and a pulse output unit configured to receive an output signal from the OR gate and output a pulse signal corresponding to the output signal from the OR gate as the reset signal from the oscillator.

10. A light emitting diode (LED) driver apparatus, comprising:

a synchronization unit configured to measure a feedback voltage of an LED array or a constant current flowing through the LED array to determine a point in time to drive the LED array, generate a reset signal to an oscillator at a pulse width modulation (PWM) signal generation unit at the point in time when the LED array is driven, generate the reset signal to reset a clock signal of the oscillator in response to the feedback voltage of the LED array being equal to or lower than a preset first reference voltage, and generate the reset signal to the oscillator in response to the current provided to the LED array being equal to or greater than a preset first reference current to maintain a constant output voltage and a constant output current.

11. The LED driver apparatus as claimed in claim 10, wherein the pulse width modulation (PWM) signal generation unit is configured to generate a PWM signal using the oscillator having a preset frequency.

12. The LED driver apparatus as claimed in claim 11, further comprising:

a direct current (DC)-DC converter configured to provide a driving voltage to the LED array using the generated PWM signal; and an LED driving unit configured to drive the LED array using a dimming signal.

13. The LED driver apparatus as claimed in claim 10, wherein the preset first reference voltage is greater than the feedback voltage at a normal operation of the LED array.

14. The LED circuit apparatus as claimed in claim 12, wherein the LED driving unit is further configured to drive a plurality of LED arrays, wherein the synchronization unit comprises:

a plurality of comparators, each comparator configured to output a high level signal when the feedback voltage of corresponding one of the plurality of LED arrays is equal to or lower than the preset first reference voltage;

an OR gate configured to receive output signals of the plurality of comparators and output a logic-OR result; and a pulse output unit configured to receive an output signal of the OR gate and output a pulse signal corresponding to the output signal of the OR gate as the reset signal from the oscillator.

15. The LED driver apparatus as claimed in claim 10, wherein the synchronization unit comprises a current comparator comprising:

a current source configured to output the preset first reference current;

a transistor configured to receive a feedback voltage from the LED array at a drain thereof;

first and second resistors operatively connected in series between the current source and a ground terminal;

a third resistor arranged between a source of the transistor and the ground terminal;

a first operational amplifier of which a non-inverting terminal operatively connected to a first node commonly connected to the current source and one terminal of the first resistor, an inverting terminal operatively connected to a second node, which is commonly connected to a source of the transistor and the third resistor, and an output terminal operatively connected to a gate of the transistor; and a second operational amplifier comprising an inverting terminal operatively connected to a third node, which is commonly connected to another terminal of the first resistor and one terminal of the second resistor, and a non-inverting terminal operatively connected to the second node, which is commonly connected to the source of the transistor and the third resistor, and configured to output an input difference between the non-inverting terminal and the inverting terminal as the reset signal from the oscillator.

16. The LED driver apparatus as claimed in claim 10, wherein the preset first reference current is lower than a constant current at a normal operation of the LED array.

17. The LED driver apparatus as claimed in claim 12, wherein the LED driving unit is further configured to drive a plurality of LED arrays, wherein the synchronization unit comprises:

a plurality of current comparators, each current comparator configured to output a high level signal when a current flowing in one of the corresponding plurality of LED arrays is equal to or greater than the preset first reference current;

an OR gate configured to receive output signals from the plurality of current comparators and output a logic-OR result; and a pulse output unit configured to receive an output signal from the OR gate and output a pulse signal corresponding to the output signal from the OR gate as the reset signal from the oscillator.

* * * * *